US009303436B1

(12) United States Patent
Dillard

(10) Patent No.: US 9,303,436 B1
(45) Date of Patent: Apr. 5, 2016

(54) PORTABLE DOOR RESTRAINT

(76) Inventor: Todd B. Dillard, Little Rock, AR (US)

( * ) Notice: Subject to any disclaimer, the term of this patent is extended or adjusted under 35 U.S.C. 154(b) by 553 days.

(21) Appl. No.: 13/564,979

(22) Filed: Aug. 2, 2012

(51) Int. Cl.
*E05B 39/02* (2006.01)
*E05C 21/00* (2006.01)

(52) U.S. Cl.
CPC ..... *E05C 21/00* (2013.01)

(58) Field of Classification Search
USPC ..... 292/288
See application file for complete search history.

(56) References Cited

U.S. PATENT DOCUMENTS 3,893,725 A * 7/1975 Coulter et al. ..... 292/258
4,712,816 A 12/1987 Mueller
5,129,695 A * 7/1992 Norman, II ..... 293/128
5,209,533 A 5/1993 Menard
5,501,207 A * 3/1996 Black ..... F41B 3/02 124/20.1
5,810,404 A * 9/1998 Horne ..... E05C 19/182 292/288
5,918,915 A * 7/1999 Calteux ..... 292/1
D705,039 S * 5/2014 Dillard ..... D8/343
2008/0042451 A1* 2/2008 Moore et al. ..... 292/288

* cited by examiner

*Primary Examiner* — Mark Williams

(57) ABSTRACT

A reusable, portable door restraint for keeping a door closed without permanently modifying the structure or surface of the door, the door restraint comprising two straps with each including a first side having an adhesive surface, and a second side having a non-adhesive surface; a means for overlapping the adhesive surfaces of the ends of each strap to form a strap member; and a means for forming a tab at the free ends of the strap member. Alternatively, the strap member may be a single strap having a first segment having an adhesive surface on the top side and a non-adhesive surface on the opposite bottom side, a middle segment having two non-adhesive surfaces on each side, and a third segment having a non-adhesive surface on the top side and an adhesive surface on the bottom side. It may be assembled, installed, and removed without using tools or other components.

18 Claims, 5 Drawing Sheets

PORTABLE DOOR RESTRAINT

CROSS-REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION (1) Field of Invention

The present invention is a portable door restraint for preventing a door from being opened. This restraint may be installed without permanently modifying the surface of the door, a door frame (or door jamb), an adjacent wall or other structure. No tools or additional components are needed for installation or removal of this restraint. The restraint may be installed at any height suitable for preventing a small child from opening the door, while simple enough for a taller individual to detach the restraint to open the door.

(2) Background of the Invention

One common problem that parents of a small child encounter is keeping a door closed after the child is tall enough to reach the door knob. Some doors, including cabinet doors or drawers, do not have an existing lock or a lock that is sufficient in keeping the child from opening the door. Another problem is that installation of a traditional locking mechanism may permanently modify the door.

Many existing auxiliary child-proof door locking mechanisms have multiple components and require tools for installation and removal. Some locking mechanisms require mounting to the door, the door frame, door jamb, adjacent wall or other support member (collectively, the "door structure"). Mounting the locking mechanism to the door structure may require drilling or otherwise creating at least one hole in the door structure so that at least one fastener can secure the locking mechanism. Furthermore, mounting the locking mechanism may leave an undesirable, permanent alteration to the door structure, even after the locking mechanism has been removed. Many locking mechanisms are expensive or are difficult to assemble and operate. Further still, some cannot be easily removed and reused. Most of these are not portable for use while travelling because additional tools or several components are needed for installation. This is a significant disadvantage because many locations, such as hotels or public restrooms, may prohibit a person from modifying their door structures.

Some locking mechanisms are made from plastic which may inadvertently break during installation, use or removal. Others are made from metal or synthetic materials and must be used with some kind of an anchor or other attachment for mounting to the door structure. The configuration and appearance of these locking mechanisms often detract from the area's décor, and are visually distracting. Even still, some locking mechanisms are so intricate that someone with specific knowledge or experience with a particular locking mechanism is needed for assembly and installation.

The arguably relevant disclosures fail to solve the problem of temporarily keeping a door closed without permanently modifying the door structure and without using additional tools, by using a reusable, portable door restraint that maintains ease in selectively opening the door.

U.S. Pat. No. 5,810,404 issued to Hoyne discloses a portable door lock comprising a strap anchored at one end to the outer surface of a door near its free-swinging edge, and with the other end insertable into a locking member attached to a closure surface near the inside free-swinging edge of the door. The strap may include either the hooks or loops of a VELCRO® fastening system. The anchor, locking member, and strap prevent the hinged door from opening until the user releases the strap. U.S. Pat. No. 5,209,533 issued to Menard discloses a strap having magnets or VELCRO® fasteners at each end for anchoring to a refrigerator. U.S. Pat. No. 4,712,816 issued to Meuller discloses a door latch having a flexible tape-like member with openings in opposite end portions for detachably engaging with a door and adjacent door jamb.

None of these patents expressly discloses a portable door restraint comprising at least two straps, with each strap having at least one side having an adhesive surface, a means for overlapping the adhesive surface of an end of each strap to form a single, overlapped strap member, and a tab located at each free end of the strap member. None of these patents expressly discloses a restraint comprising a single strap member having a middle segment including two non-adhesive sides. None of these patents expressly discloses the strength and benefit of overlapping the ends of the straps, a strap having a variable length to accommodate different door sizes and types, or a strap made from a flexible material. Furthermore, none of these disclosures teach or suggest that the respective disclosed inventions should be modified or combined to encompass the present invention.

Therefore, it is an object of the present invention to provide a reusable, portable door restraint that may be easily installed on (or removed from) an existing door structure without the need for tools or additional components.

Another object of the present invention is to provide a portable door restraint for preventing a door from being opened, without permanently modifying the door structure.

Another object of the present invention is to provide a portable door restraint for preventing a door from being opened, with the restraint having a variable length and width to accommodate different size doors or door structures.

Another object of the present invention is to provide a portable door restraint having a tab for easy removal.

Yet another object of the present invention is to provide a portable door restraint that is easy to manufacture, use and carry.

Another object of the present invention is to provide a portable door restraint for preventing a door from being opened that may be installed at any height suitable for preventing small children from opening the door, while simple enough for a taller individual to detach the restraint to open the door.

Another object of the present invention is to provide a portable door restraint that may used to caution or deter someone from inadvertently opening a door.

Yet another object of the present invention is to provide a multi-purpose restraint for use on a door, cabinet, window, or to temporarily repair a broken buckle.

Other objects and advantages of the invention will become more apparent from the summary and detailed description.

SUMMARY OF INVENTION

The present invention is a portable door restraint for preventing a door from being opened without permanently modifying the door structure. In a preferred embodiment, the present invention is a portable door restraint for preventing a door from being opened, the restraint comprising (including or having) at least two flexible straps, each strap having a first end, a second end, a first side having an adhesive surface, and a second side; a means for overlapping the adhesive surface of an end of each strap to form a single strap member; and a means for forming a tab at each free end of the strap member. The opposite second side of the strap may have a non-adhesive surface. The individual straps may be made from a flexible material. The tab may be prefabricated into any shape or configuration that is sufficient for use as a hand grip or finger grip. Alternatively, the tab may be folded, pinched, or pressed into a desired shape or configuration by the user.

In another embodiment, a single strap having the elements of the strap member is employed. This version of the strap member includes a first segment including a first side having a non-adhesive surface, a second side having an adhesive surface, and a tab; a middle segment having two sides, with each side having a non-adhesive surface; and a third segment including a first side having an adhesive surface, a second side having a non-adhesive surface, and a tab.

The restraint does not require multiple components, additional tools, or any particular skill or expertise for installation or removal. A key or combination code is also not needed. The restraint may be installed at any height on a door. These benefits are advantageous to parents because a parent may easily detach the strap member to open a door, then replace it to prevent a child from opening the door. The restraint may also be used to alert someone attempting to open the door to proceed with caution, or to warn someone not to open the door.

The restraint is small, inexpensive and lightweight, durable and non-invasive, and may be easily carried or stored. Due to its ease and portability, the restraint is readily available for use whenever a temporary restraint is needed. It may be available in a variety of colors and aesthetic patterns. Once the straps are assembled into the single strap member, it may be reused multiple times. The user saves money and time by reusing the restraint rather than purchasing and installing several different locking mechanisms for each door, drawer, or window. The restraint may be used in hotel rooms, public restrooms, and the homes of family and friends. This flexibility allows the user to quickly and temporarily child-proof nearly any area or location.

Application of this restraint is not limited to child-proofing an area. It may also be used, without limitation, during construction, film production, or other activities, where inadvertently opening a door or window may result in injury, accident or damage to life and property. The restraint, or even a single strap, may also be used to cover electrical outlets and appliance knobs or buttons, and to temporarily repair broken buckles.

DETAILED DESCRIPTION OF THE INVENTION

For the sake of simplicity and to give the claims of this patent application the broadest interpretation and construction possible, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

The restraint is a cost-effective way of keeping a door closed. The restraint may be purchased as a supplemental or auxiliary item for attachment to an existing door, drawer, or window. The term "door" may be selected from the group consisting of a door having a free-swinging leading edge, a two-way swinging door, French doors, sliding doors, cabinet doors, drawers, seat lids, gates, windows and combinations thereof. This restraint may be used on any size or type of door because the user may selectively make adjustments to the length of the strap member by using longer straps. For example, each strap may be at least eight (8) inches long. Multiple straps may be needed to keep the door from being opened. The strap member may be used on windows that open upwardly, sideways, inwardly or outwardly. The strap member fits between the gap where the outer leading edge of the door abuts the inner face of the door frame or other structure.

As depicted in FIGS. 1-7, the restraint comprises (includes or having) a first strap and a second strap, each of the straps having a first end, a second end, a first side having an adhesive surface, and a second side. The restraint further includes a means for inverting and overlapping the adhesive surface of the first end of the first strap over the adhesive surface of the first end of the second strap to form a single overlapped strap member, with the strap member having two free ends; and a means for forming a tab at each free end of the strap member. The "free ends" of the strap member are essentially the second ends of the individual straps. Once assembled, the strap member comprises a first segment, a middle segment, and a third segment. The first segment includes a first side having a non-adhesive surface, a second side having an adhesive surface, and a tab. The middle segment includes two sides, with each of the sides having a non-adhesive surface. The third segment includes a first side having an adhesive surface, a second side having a non-adhesive surface, and a tab.

Figure 1:
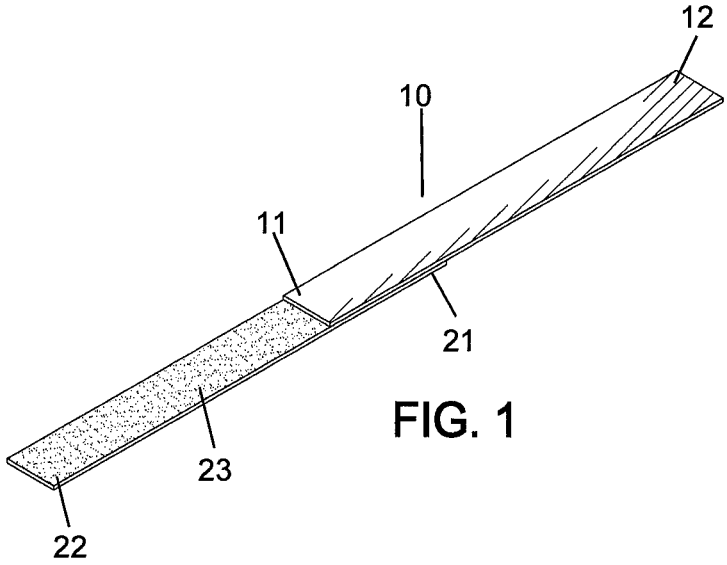
FIG. 1 is a perspective view of one embodiment of the present invention.
Figure 2:
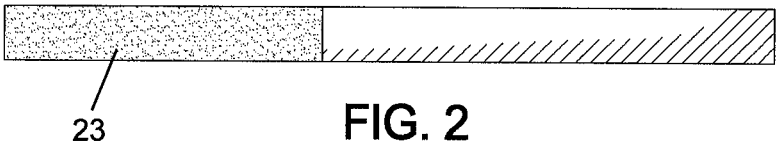
FIG. 2 is a top plan view thereof.
Figure 3:
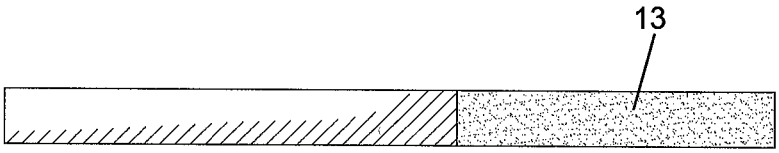
FIG. 3 is a bottom plan view thereof.
Figures 4, 5, 6, 7:
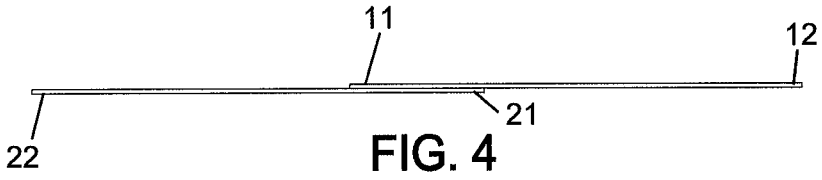
FIG. 4 is a left side elevation view thereof.
FIG. 5 is a right side elevation view thereof.
FIG. 6 is a front elevation view thereof.
FIG. 7 is a rear elevation view thereof.
Figure 8:
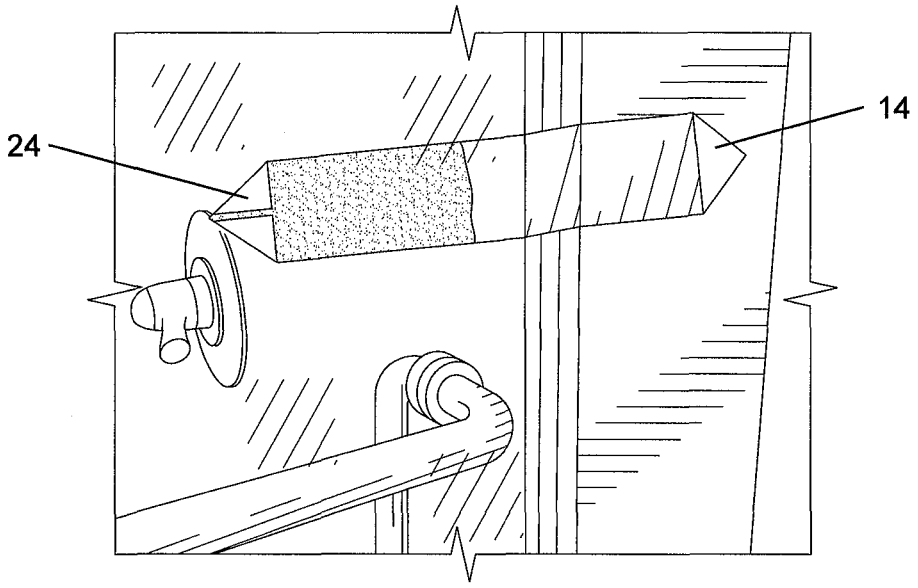
FIG. 8 is a perspective view of the strap member installed on a door.
Figure 9:
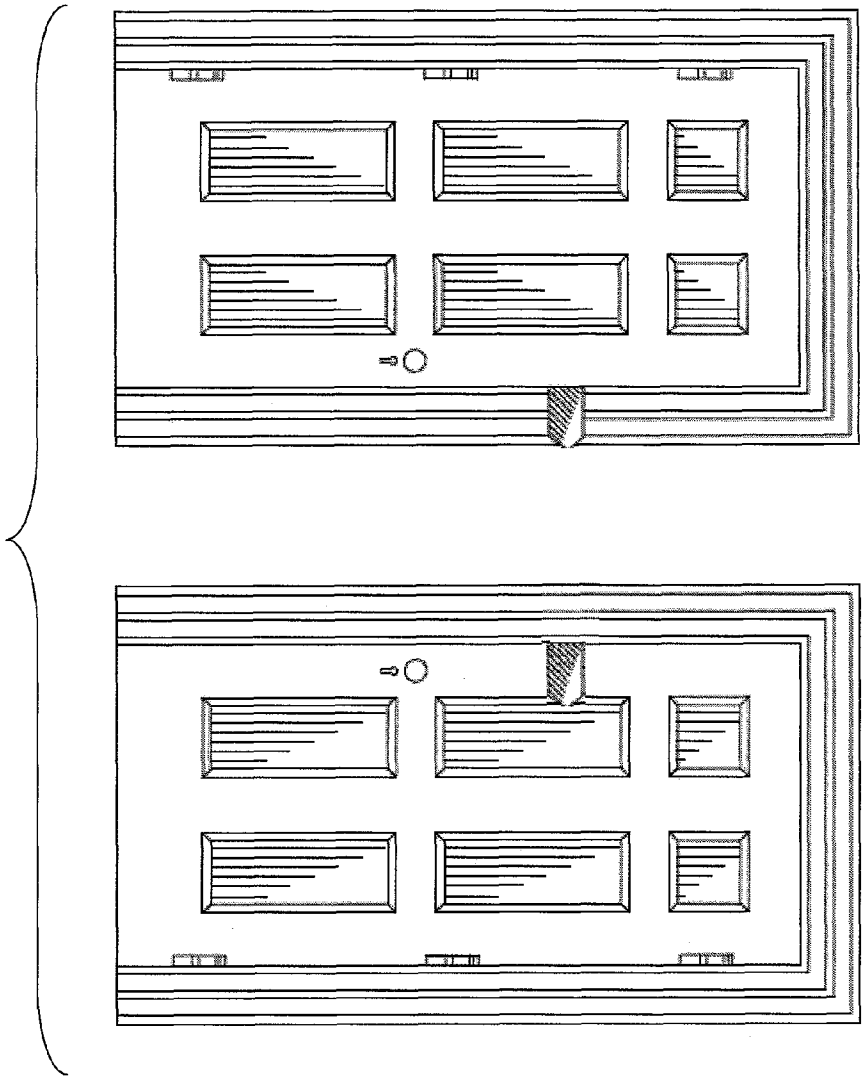
FIG. 9 is a front elevation view and rear elevation view of the strap member installed on a door.
Figure 10:
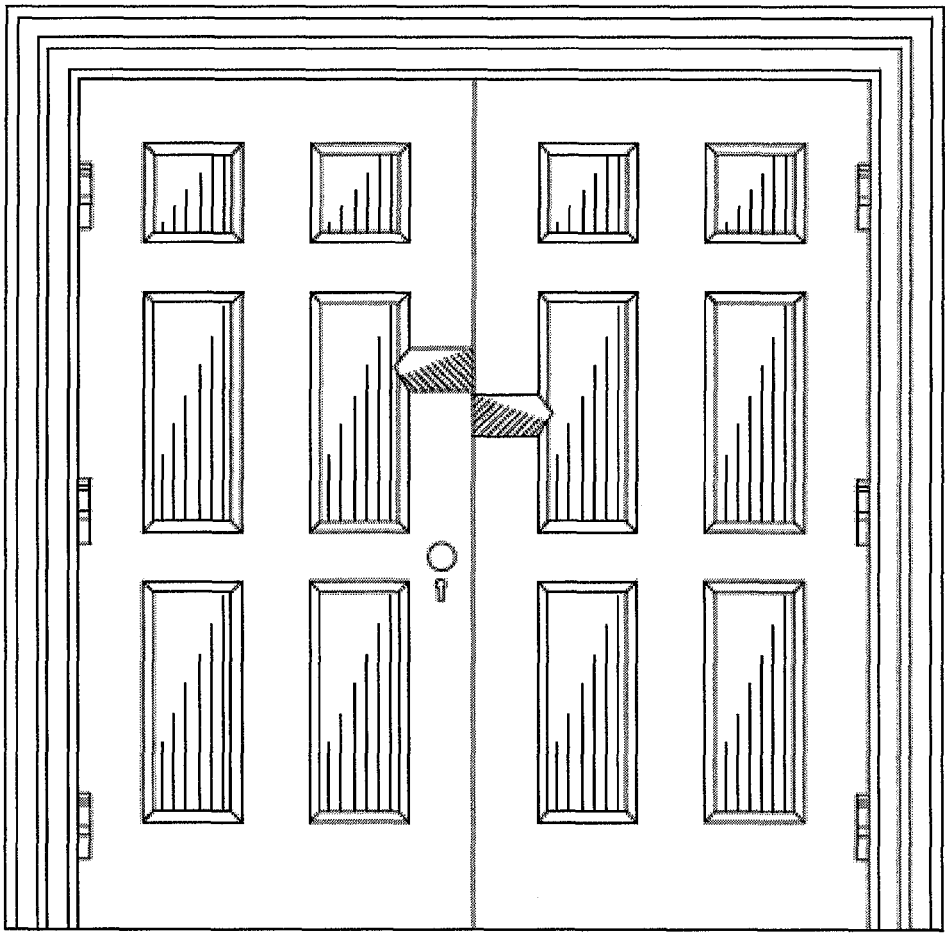
FIG. 10 is a front elevation view of the strap member installed on double doors; the rear elevation view is a mirror image.

FIGS. 8-10 depict that the strap member must be thin enough so that it can bend and fit within the gap between the outer leading edge of the door and the door frame whenever the door is closed. The strap member is essentially bent into a "Z" configuration once it is attached. Any of the edges or ends of the strap or strap member may be designed into any shape or ornamentation including without limitation, straight, scalloped, rounded and any combination thereof. Each strap may be made from a material selected from the group consisting of tape, tape-like material, cloth, synthetic materials, natural materials, plastics, plastic film, metal foil, and combinations thereof. Some straps may further include a peel-away, removable liner that attaches to the adhesive surfaces of each strap. The length of the first strap and second strap may be selected from the group consisting of a predetermined pre-cut length, a customizable length as determined by the user, and combinations thereof. Each strap may be pre-cut or perforated at a predetermined length based on a variety of dimensions. In the alternative, a user can cut each strap to a desired length. In one embodiment, the user may cut each strap 8 inches long. The straps may be provided on a roll, a spool, in a packet, or individually. The straps may also be provided in an envelope, container or other package with the straps folded over each other. Because the adhesive surface of the strap can be reused more than once without leaving residue or permanently adhering to each other, the straps may be stored or provided one on top of the other. Thus, the adhesive surface on the bottom of one strap may be pressed against, or otherwise placed on top of, the non-adhesive surface on another strap.

In an embodiment wherein the strap member is an assembly of tape, each tape includes a first side having a non-adhesive surface and a second side having an adhesive surface. A second tape is inverted so that a portion of the adhesive surface adheres to a portion of the adhesive surface of the first tape. The tape may be selected from the group consisting of duct tape, gaffer tape, medical tape, and combinations thereof.

The strap member may be attached in any manner suitable for preventing the door from being opened. The strap member may be attached at an angle, or in any other arrangement, to accommodate an unusual door or lock. As depicted in FIG. 10, the strap member may be attached in a figure-8 pattern on a French door, double door, or swinging door. Multiple straps may be used to lengthen or to increase the width of the strap member.

Attaching the strap member(s) onto double doors may depend on the type of double door. For example, the double doors may have a central divider or frame wherein one door opens independently from the other. Here, the method of using the strap member may be employed. Alternatively, the strap member may be attached vertically from the top of the door frame and to the top of the door, using the preferred method. In other example, the double doors are not separated by a central divider wherein the outer leading edge of the door abuts that of the opposite door so that they are closed door-to-door, as depicted in FIGS. 8 and 10. Here, two strap members are used in conjunction with each other, with the adhesive surface of one end of a first strap member attached to the back of the first door and the adhesive surface of one end of a second strap member attached to the back of the second door, slightly above or below the level of the first strap member. As the doors are slightly closed, each strap member is bent around the edge of its opposite door to attach to the front of that door.

In yet another embodiment, the strap member is a single strap comprising a first segment including a first side having a non-adhesive surface, a second side having an adhesive surface, and a tab; a middle segment having two sides, with each side having a non-adhesive surface; and a third segment including a first side having an adhesive surface, a second side having a non-adhesive surface, and a tab. Here, the middle segment does not include any adhesive surfaces because overlapping is not needed. The strap member is one unitary strap having an adhesive surface on the top of the first segment and an adhesive surface on the bottom of the third segment.

The adhesive surface may made from a connective material selected from the group consisting of a pressure-sensitive adhesive, a structural adhesive, a synthetic rubber adhesive, a natural rubber adhesive, sewing, glue, a solvent-activated adhesive, a water-activated adhesive, a heat-activated adhesive, fastening and combinations thereof. A pressure-sensitive adhesive is the preferred type of connective material. Pressure-sensitive adhesive is an adhesive which forms a bond when pressure is applied to join the adhesive with another adherent. No other component, such as solvent, water, or heat, is needed to activate the adhesive. Since this restraint may be removed and reused, an adhesive material should be used which does not leave residue or remove a coating, such as paint, from the door structure.

Overlapping the adhesive surfaces of each end of the two straps together creates a single assembled strap member. The middle segment is essentially a portion of the adhesive surface of the first end of the first strap overlapping a portion of the adhesive surface of the first end of the second strap, resulting in two non-adhesive surfaces. The second strap is inverted so that the adhesive surface mates with the adhesive surface of the first strap. Once assembled as depicted in FIGS. 1-7, the top of one end segment of the strap member has an adhesive surface, while the bottom of the opposite end segment has an adhesive surface. The middle segment may be overlapped at any length or portion suitable for securing and strengthening the assembled strap member. In one embodiment, the middle segment may be overlapped by two (2) inches. Thus, the strap member may be fourteen (14) inches long if each strap is eight (8) inches long with a two (2) inch overlap. Overlapping will increase the connection and strength of the strap member as a whole. Moreover, overlapping the two ends will also minimize the strap member from being ripped or torn during attempts to open the door.

The tab is not only for ornamental aesthetics, but is also used as a handgrip or a finger grip for adjusting or removing the restraint from the door structure. The means for forming the tab include configuring each free end of the strap member into any shape selected from the group consisting of square (FIGS. 1-7), rectangular, 45 degree angle, a right angle, an arrow (FIGS. 8-10), scalloped, rounded and combinations thereof. In one embodiment, the user may form the tab by manipulating the adhesive surface of the strap onto itself into any of the aforementioned configurations selected from the group consisting of pressing, folding, bending, pinching, gluing or sewing the adhesive surfaces at the free end of the tape together, and combinations thereof. In another embodiment, the tab is pre-folded to any of the aforementioned shapes and configurations. Unless the tab has already been formed, the user should form the tab before installation of the strap member. Once formed, the user would grip the non-adhesive surface of the tab for adjusting or removing the restraint.

In yet another embodiment, the restraint may be used on cabinet doors, drawers, windows, and small openings to prevent someone from opening or accessing the same. A strap member (or even a single individual strap) may also be used for different applications including, without limitation, covering an electrical outlet or appliance knob, or temporarily repairing a broken buckle from a seat, a high chair, or a shopping cart. An example of an appliance knob is a garbage disposal's manual switch. To repair a broken buckle, the adhesive surface of one end of the strap member may be wrapped around one of the buckles, then the opposite end of the strap member may be wrapped around the other buckle. This is a temporary solution to repairing a broken buckle, rather than an attempt to permanently replacing a functioning buckle as a restraining restraint.

A method of using the portable door restraint for preventing a door, drawer or window from opening without permanently modifying the door structure, the door having a door surface and a outer leading edge for abutting against the inner face of a door frame or other support structure, the method comprises the steps of:

A. forming a tab at a second end of each of a first strap and a second strap for adjusting or removing the restraint, the first strap and second strap each including a first end, a second end, a first side having an adhesive surface, and a second side having a non-adhesive surface;

B. creating a single overlapped strap member by inverting the second strap and overlapping a portion of the adhesive surface of the first end of the first strap over the adhesive surface of the first end of the second strap, with the strap member comprising a first segment including a first side having a non-adhesive surface, a second side having an adhesive surface, and a tab; a middle segment having two sides, each side having a non-adhesive surface; and a third segment including a first side having an adhesive surface, a second side having a non-adhesive surface, and a tab;

C. attaching the adhesive surface of the first segment of the strap member to the door frame or other support structure;

D. bending the non-adhesive surface of the strap member's middle segment around the outer leading edge of the door as the door is closed, with the non-adhesive surface of the strap member's middle segment abutting the inner face of the door frame; and E. attaching the adhesive surface of the third segment of the strap member to the surface of the door.

Bending the strap member around the leading edge of the door and attaching to the opposite wall or door frame essentially creates an anchor for the strap member when pulling forces are applied to the strap member in an attempt to open the door. If the restraint had an adhesive surface exposed around the edge of the door, it would inadvertently adhere to the leading edge of the door and the inner face of the door frame. The order of application for installation or removal may be reversed, depending on the situation. To detach the restraint, the user pulls the tab away from the door surface or the door structure before opening the door and disengaging the opposite tab. To reattach the restraint, the method is repeated. The door frame, door jamb, or other support structure may be another door if the restraint is installed on double doors. This method of installing the restraint is also applicable to drawers, cabinets and windows.

Those skilled in the art who have the benefit of this disclosure will appreciate that it may be used as the creative basis for designing devices or methods similar to those disclosed herein, or to design improvements to the invention disclosed herein; such new or improved creations should be recognized as dependent upon the invention disclosed herein, to the extent of such reliance upon this disclosure.

I claim:

1. A portable, reusable restraint device for attachment to a door or drawer having a face surface and an edge for abutting against an inner face of an adjacent framing structure of the door or drawer, or for attachment to said door having an edge adjacent that of second door, said restraint device restraining opening of the door or drawer and comprising:

(a) a first strap and a second strap, each of said straps having a first end, a second end, a first side having an adhesive surface including said first end, and a second side;

(b) said adhesive surface of said first end of said first strap being inverted and overlapping said adhesive surface of said first end of said second strap to form a single overlapped strap member, said strap member having one of said second ends for adhesion attachment to the face surface and the other second end for adhesion attachment to the framing structure or adjacent second door; and (c) each of said second ends having a terminal portion including an adhesion-free tab for manual detachment of said second end from the door or drawer.

2. The restraint device of claim 1, said first strap and said second strap each further comprising said first side having a non-adhesive surface.

3. The restraint device of claim 2, said strap member further comprising a middle segment having no outer adhesive surface and having at least double the thickness of said ends.

4. The restraint device of claim 1, said first strap and said second strap selected from the group consisting of tape, tape-like material, cloth, synthetic materials, natural materials, plastics, plastic film, metal foil, and combinations thereof.

5. The restraint device of claim 1, said adhesive surface of said second strap inverting and overlapping said adhesive surface of said first strap at least two inches.

6. The restraint device of claim 1, said first strap and said second strap each further comprising a removable liner attaching to each of said adhesive surfaces.

7. The restraint device of claim 1, said adhesive surface selected from the group consisting of a pressure-sensitive adhesive, a structural adhesive, a synthetic rubber adhesive, a natural rubber adhesive, sewing, glue, a solvent-activated adhesive, a water-activated adhesive, a heat-activated adhesive, fastening and combinations thereof.

8. The restraint device of claim 7, said adhesive surface of each of said first strap and said second strap comprising a pressure-sensitive adhesive.

9. The restraint device of claim 3, said restraint further comprising said adhesive surface of said first segment attached to a door frame, said middle segment bending around the edge of a door and abutting an inner face of the door frame, and said adhesive surface of said third segment attached to the surface of the door.

10. The restraint device of claim 1, said first strap and said second strap having a length selected from the group consisting of a predetermined pre-cut length, a customizable length as determined by a user, and combinations thereof.

11. The restraint device of claim 1, the door selected from the group consisting of a swinging door, double doors, French doors, cabinet doors, drawers, lids, gates, windows, and combinations thereof.

12. A portable, reusable restraint device for attachment to a door or drawer having a face surface and an edge for abutting against an inner face of an adjacent framing structure, or for attachment to said door having an edge adjacent that of a second door, said restraint device restraining opening of the door or drawer and comprising:

(a) a first strap and a second strap, each of said straps comprising a first end, a second end, a first side having a non-adhesive surface, and a second side having an adhesive surface on said first end and second end;

(b) said adhesive surface of said first end of said first strap being inverted and overlapping said adhesive surface of said first end of said second strap to form a single overlapped strap member, said strap member having one of said second ends for adhesion attachment to the face surface and the other second end for adhesion attachment to the framing structure or adjacent second door;

(c) each of said second ends including an adhesion-free tab for manual detachment of said second end from the door or drawer; and (d) said strap member further comprising a middle segment comprising a non-adhesive surface on both sides.

13. The restraint device of claim 12, said first strap and said second strap selected from the group consisting of tape, tape-like material, cloth, synthetic materials, natural materials, plastics, plastic film, metal foil and combinations thereof.

14. The restraint device of claim 12, said adhesive surface selected from the group consisting of a pressure-sensitive adhesive, a structural adhesive, a synthetic rubber adhesive, a natural rubber adhesive, sewing, glue, a solvent-activated adhesive, a water-activated adhesive, heat-activated adhesive, fastening and combinations thereof.

15. The restraint of claim 14, said adhesive surface of each of said first strap and said second strap comprising a pressure-sensitive adhesive.

16. The restraint device of claim 12, said first strap and said second strap each further comprising a removable liner attaching to each of said adhesive surfaces.

17. The restraint device of claim 12, said adhesive surface of said first strap overlapping said adhesive surface of said second strap at least two inches.

18. The restraint device of claim 12, said non-adhesive surface of said middle segment bending around the leading edge of the door selected from the group consisting of a swinging door, double doors, French doors, cabinet doors, drawers, lids, gates, windows, and combinations thereof.

* * * * *